US010993536B2

(12) United States Patent
Pu

(10) Patent No.: US 10,993,536 B2
(45) Date of Patent: May 4, 2021

(54) CHAIR ASSEMBLY

(71) Applicant: Chang-Chen Lin, Tainan (TW)

(72) Inventor: Yao-Nan Pu, Jiaoxi Township (TW)

(73) Assignee: Chang-Chen Lin, Tainan (TW)

( * ) Notice: Subject to any disclaimer, the term of this patent is extended or adjusted under 35 U.S.C. 154(b) by 13 days.

(21) Appl. No.: 16/662,260

(22) Filed: Oct. 24, 2019

(65) Prior Publication Data

US 2021/0068544 A1 Mar. 11, 2021

(30) Foreign Application Priority Data

Sep. 5, 2019 (TW) ..... 108211843

(51) Int. Cl.
*A47C 1/032* (2006.01)
*A47C 1/034* (2006.01)
*A47C 1/024* (2006.01)

(52) U.S. Cl.
CPC ..... *A47C 1/0347* (2013.01); *A47C 1/0242* (2013.01); *A47C 1/0345* (2013.01); *A47C 1/03272* (2013.01)

(58) Field of Classification Search
CPC ... A47C 1/0347; A47C 1/0242; A47C 1/0345; A47C 1/03272
See application file for complete search history.

(56) References Cited

U.S. PATENT DOCUMENTS 3,363,942 A * 1/1968 Fletcher ..... A47C 1/0352 297/322
3,567,280 A * 3/1971 Bradshaw ..... A47C 1/03294 297/318
4,966,411 A * 10/1990 Katagiri ..... A47C 1/03294 297/300.7
6,644,741 B2 * 11/2003 Nelson ..... A47C 1/03255 297/300.1
7,614,697 B1 * 11/2009 Lai ..... A47C 1/03255 297/301.1
8,752,896 B2 * 6/2014 Takeuchi ..... A47C 1/03272 297/300.2
9,215,932 B2 * 12/2015 Birkbeck ..... A47C 1/03277
9,364,091 B2 * 6/2016 Costaglia ..... A47C 1/032
9,474,375 B2 * 10/2016 Robertson ..... A47C 7/40
9,622,580 B2 * 4/2017 Slongo ..... A47C 1/032
10,178,913 B2 * 1/2019 He ..... A47C 1/03274
10,334,951 B2 * 7/2019 Robertson ..... A47C 1/03294

* cited by examiner

*Primary Examiner* — David R Dunn
*Assistant Examiner* — Tania Abraham
(74) *Attorney, Agent, or Firm* — Alan D. Kamrath; Karin L. Williams; Mayer & Williams PC

(57) ABSTRACT

A chair assembly includes a supporting frame disposed above a base and including a first guiding groove. A seat is pivotably connected to a backrest. Lower and front guiding wheels are mounted to rear and front ends of the seat, respectively. At least one operating board includes rear and front ends respectively having second and third guiding grooves. The lower guiding wheel is movably received in the first and second guiding grooves. The front guiding wheel is movably received in the third guiding groove. A first operating rod is pivotably connected between the supporting frame and the seat. When the operating rod retracts, the lower guiding wheel is located in rear ends of the first and second guiding grooves, and the front guiding wheel is located in a rear end of the third guiding groove. The seat moves downwards and rearwards, and the front end of the seat inclines upwards.

10 Claims, 9 Drawing Sheets

CHAIR ASSEMBLY

BACKGROUND OF THE INVENTION

The present invention relates to a chair assembly and, more particularly, to a chair assembly providing smoother and more stable operation as well as comfort.

Conventional chairs include a backrest with an adjustable reclining device to provide improved sitting comfort. FIG. 8 shows a conventional chair including a base 1', a seat 2', and a backrest 3'. Two armrests 11' are disposed above the base 1', and two guiding rods 12' are attached to an intermediate portion of the base 1'. A sliding sleeves 21' is mounted around each guiding rod 12' and is located at a front end of the seat 2'. A pivotal portion 22' is disposed at a rear portion of the seat 2'. The backrest 3' includes a lower end having a pivotal portion 31' for pivotal connection with the pivotal portion 21' of the seat 2'. The backrest 3' further includes a central portion having a pivotal portion 32' for pivotal connection with the rear ends of the armrests 11', such that the backrest 3' and the seat 2' provide a smaller sitting angle. The backrest 3' can recline to move the seat 2' forwards, and the sliding sleeves 21' can move to the front ends of the guiding rods 12'. Thus, the backrest 3' and the seat 2' provide a larger lying angle.

In the above structure, the seat 2' can only move forwards through actuation by the backrest rest 3'. The front end of the seat 2' has a smaller upward inclining angle θ 1, such that most of the weight of the user is supported by the seat 2', failing to provide satisfying comfort. Furthermore, the above structure cannot independently control the angular position of the backrest 3', providing limited applications.

FIG. 9 shows another conventional chair including a base 4', a seat 5', and a backrest 6'. A leg rest 51' is disposed at a front end of the seat 5'. A spring 52' is attached between the seat 5' and the seat 4'. The backrest 6' is at a fixed angular relation with the seat 5' and includes a pivotal portion 61' pivotably connected to the seat 4', such that when the user is lying against the backrest 6', the backrest 6' and the seat 5' pivot about the pivotal portion 61' and stretches the spring 52' which limits the reclining angle of the backrest 6'. Furthermore, the upward inclining angle θ2 of the seat 5' relative to the ground can increase significantly, such that most of the weight of the user can be imparted to the backrest 6', providing improved lying comfort similar to rotation in a zero-gravity state.

However, the seat 5' pivots rearwards while the backrest 6' reclines, such that the gravity significantly shifts to a location behind the seat 4'. As a result, the whole chair could topple due to the unstable center of gravity. Furthermore, the upward inclining angle θ2 of the seat 5' is much larger than the lying angle of average users, failing to provide satisfying comfort. Furthermore, the angular position of the backrest 6' fixed to the seat 5' cannot be controlled independently, providing limited applications.

BRIEF SUMMARY OF THE INVENTION

An objective of the present invention is to provide a chair assembly providing smoother and more stable operation as well as improved comfort.

A chair assembly according to the present invention comprises:

a base;

a supporting frame disposed above the base and including at least one supporting board extending perpendicularly to a ground, wherein the at least one supporting board includes a rear side having a first guiding groove, and wherein the first guiding groove including an inclined groove section extending rearwards and downwards;

a backrest;

a seat including a rear end pivotably connected to the backrest, permitting adjustment of a reclining angle of the backrest, wherein the rear end of the seat includes at least one lower guiding wheel corresponding to the first guiding groove, and wherein the seat further includes a front end having at least one front guiding wheel;

an operating frame disposed below the seat and including at least one operating board disposed on a side of the at least one supporting board, wherein the at least one operating board includes a rear end having a second guiding groove and a front end having a third guiding groove, wherein the second guiding groove is aligned with and located on a side of the inclined groove section of the first guiding groove, wherein the at least one lower guiding wheel is movably received in the first guiding groove and the second guiding groove, wherein the third guiding groove has a slope different from a slope of the second guiding groove, and wherein the at least one front guiding wheel is movably received in the third guiding groove; and a first operating rod including two ends pivotably connected to the supporting frame and the seat, respectively, wherein when the first operating rod is in an extended position, the at least one lower guiding wheel is located in a front end of the first guiding groove and a front end of the second guiding groove, and the at least one front guiding wheel is located in a front end of the third guiding groove, and wherein when the first operating rod retracts, the at least one lower guiding wheel moves to a rear end of the first guiding groove and a rear end of the second guiding groove, the at least one front guiding wheel moves to a rear end of the third guiding groove, the seat moves rearwards, the rear end of the seat moves downwards while the seat is moving rearwards, and wherein the front end of the seat inclines upwards while the seat is moving rearwards.

In an example, the first guiding groove further includes a lower groove section extending downwards from a rear end of the inclined groove section. The operating frame is pivotably connected to the supporting frame. When the first operating rod is operated to move the at least one lower guiding wheel of the seat to the lower groove section, the rear end of the seat moves downwards, the operating frame pivots, and the front end of the seat inclines upwards.

In an example, the chair assembly further comprises a second operating rod. The lower end of the backrest is pivotably connected to the rear end of the seat. Two ends of the second operating rod are pivotably connected to the backrest and the seat, respectively. The second operating rod is operable to adjust a reclining angle of the backrest.

In an example, the chair assembly further comprises a footrest having a linking mechanism. The linking mechanism is pivotably connected to the seat. The linking mechanism collapses when the seat moves forwards. The linking mechanism extends when the seat moves rearwards.

In an example, the chair assembly further comprises at least one spring attached between the supporting frame and the operating frame.

In an example, the seat includes a front rod, a rear rod, and two lateral rods connected between the front rod and the rear rod. The rear rod includes at least one rear guiding member corresponding to the at least one supporting board. The at least one rear guiding member includes two side boards parallel to each other. The at least one supporting board and the at least one operating board are received between the two side boards. The at least one lower guiding wheel is disposed between lower portions of the two side boards.

In an example, the first guiding groove has a top edge parallel to a top edge of the at least one supporting board. An upper guiding wheel is disposed between upper portions of the two side boards and is located above the at least one lower guiding wheel. The upper guiding wheel is movable along the top edge of the at least one supporting board.

In an example, the at least one supporting board includes two supporting boards each having the first guiding groove. The at least one operating board includes two operating boards parallel to each other and located outside of the two supporting boards. The supporting frame further includes a transverse beam interconnected between the two supporting boards. Each first guiding groove further includes a lower groove section extending downwards from a rear end of the inclined groove section of the first guiding groove. Each of the two supporting boards includes a front, lower portion having a second pivotal portion. The seat includes a front rod, a rear rod, and two lateral rods connected between the front rod and the rear rod. The rear rod includes two rear guiding members corresponding to the two supporting boards. Each of the two rear guiding members includes two side boards parallel to each other. One of the two supporting board and one of the two operating boards are received between the two side boards of an associated one of the two rear guiding members. Each of the two rear guiding members includes a lower guiding wheel disposed between lower portions of the two side boards. The front rod includes two front guiding boards extending downwards. The at least one front guiding wheel includes two front guiding wheels respectively mounted to the two front guiding boards. The front rod further includes a rear side having a ninth pivotal portion. The operating frame further includes a connecting rod interconnected between the two operating boards. Each of the two operating boards includes a lower end having a tenth pivotal portion pivotably connected to the second pivotal portion of an associated one of the two supporting boards. The two ends of the first operating rod include a fifteenth pivotal portion and a sixteenth pivotal portion, respectively. The fifteenth pivotal portion is pivotably connected to the first pivotal portion of the supporting frame. The sixteenth pivotal portion is pivotably connected to the ninth pivotal portion of the seat.

In an example, the chair assembly further comprises a second operating rod. The backrest includes two sides each having a lower portion with a third pivotal portion. The backrest further includes a lower end having a fourth pivotal portion. Each of the two lateral rods of the seat includes a rear end having a fifth pivotal portion pivotably connected to an associated one of the third pivotal portions of the backrest. Each of the two lateral rods of the seat includes an intermediate portion having an eighth pivotal portion extending towards a center of the seat. The two ends of the second operating rod includes a seventeenth pivotal portion and an eighteenth pivotal portion, respectively. The seventeenth pivotal portion is pivotably connected to the eighth pivotal portions of the seat. The eighteenth pivotal portion is pivotably connected to the fourth pivotal portion of the backrest. Each first guiding groove has a top edge parallel to a top edge of an associated one of the two supporting boards. Each of the two rear guiding members includes an upper guiding wheel disposed between upper portions of the two side boards and movable along the top edge of an associated one of the two supporting boards. The third guiding groove is substantially parallel to the ground.

In an example, the chair assembly further comprises a footrest. The front rod of the seat includes two sixth pivotal portions and a seventh pivotal portion. The linking mechanism of the footrest includes two twelfth pivotal portions pivotably connected to two eleventh pivotal portions of the two operating boards. The linking mechanism further includes two thirteenth pivotal portions pivotably connected to the two sixth pivotal portions of the seat. The linking mechanism further includes a fourteenth pivotal portion pivotably connected to the seventh pivotal portion of the seat.

In operation

The present invention will become clearer in light of the following detailed description of illustrative embodiments of this invention described in connection with the drawings.

DETAILED DESCRIPTION OF THE INVENTION

Figure 1:
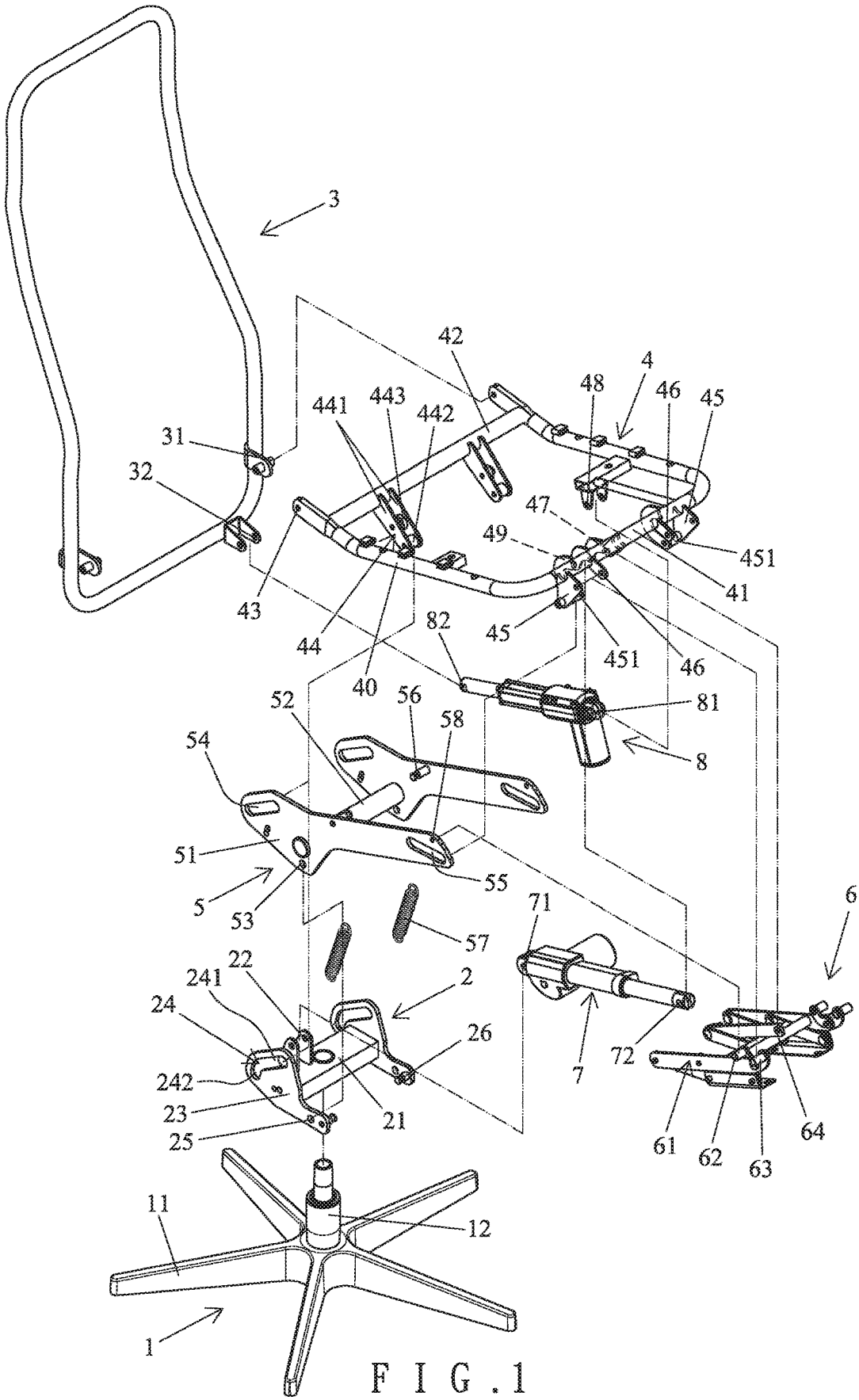
FIG. 1 is an exploded, perspective view of a chair assembly of an embodiment according to the present invention.
Figure 2:
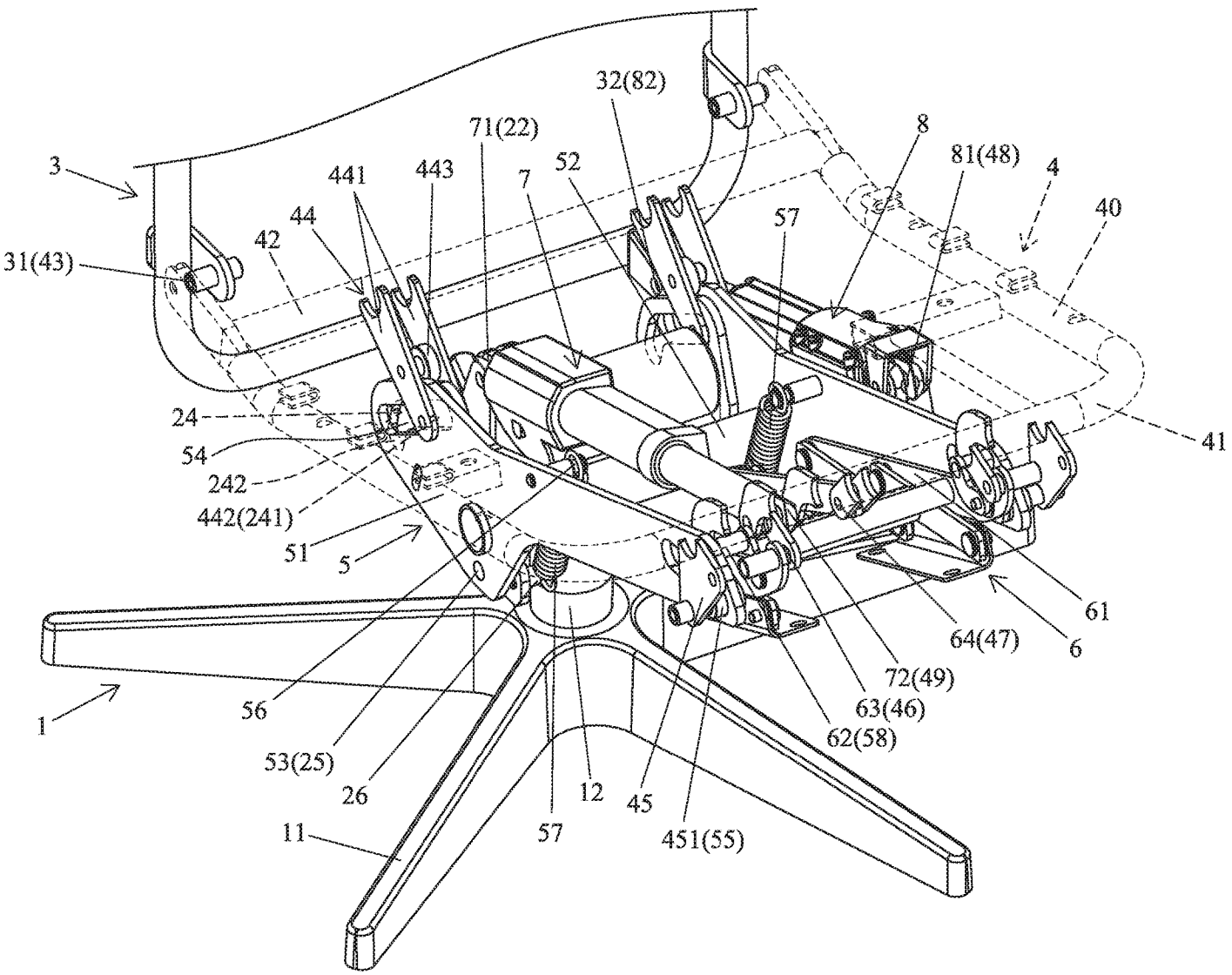
FIG. 2 is a partial, perspective view of the chair assembly of FIG. 1 with a seat moved to a forward position.
Figure 3:
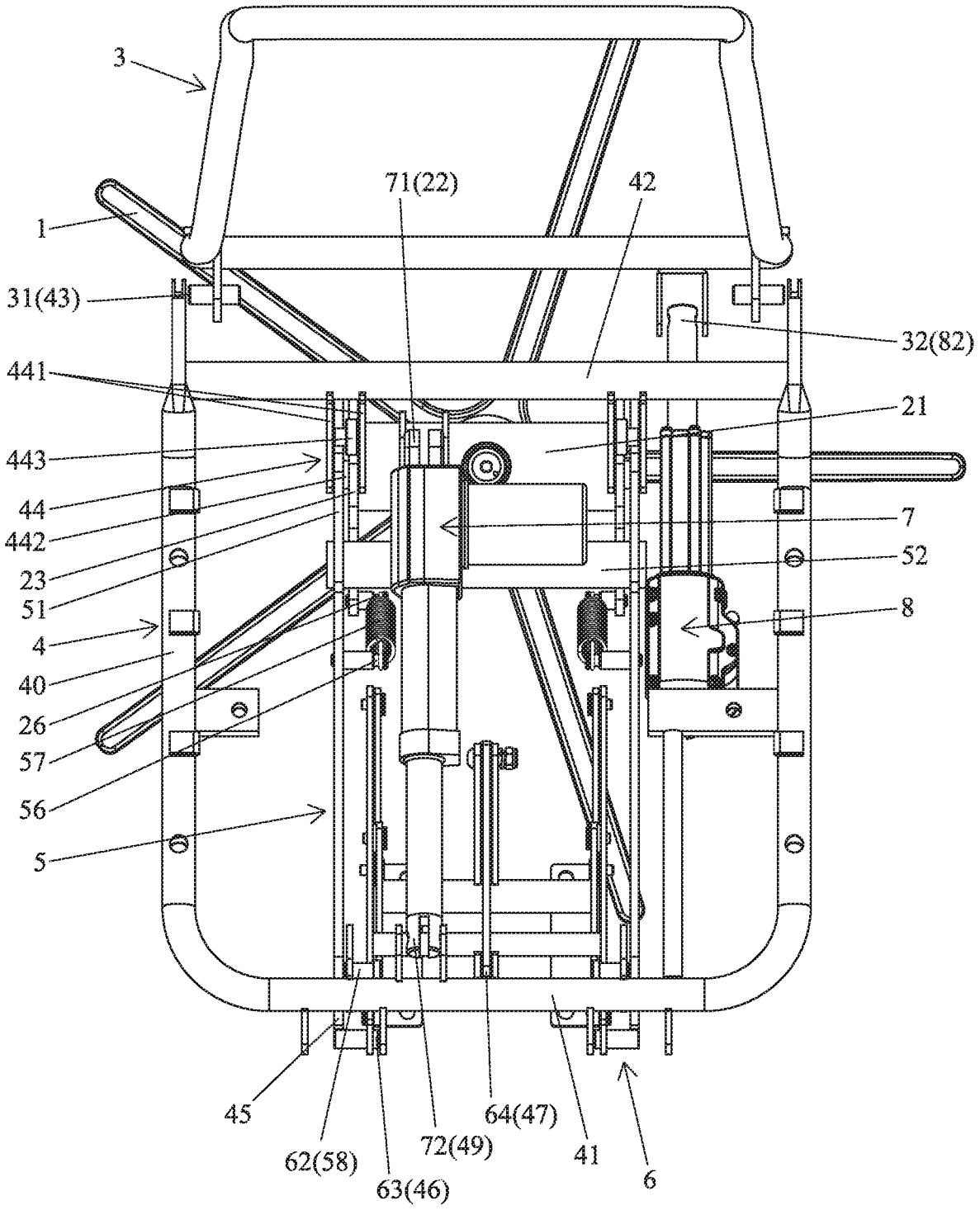
FIG. 3 is a top view of the chair assembly of FIG. 2.
Figure 4:
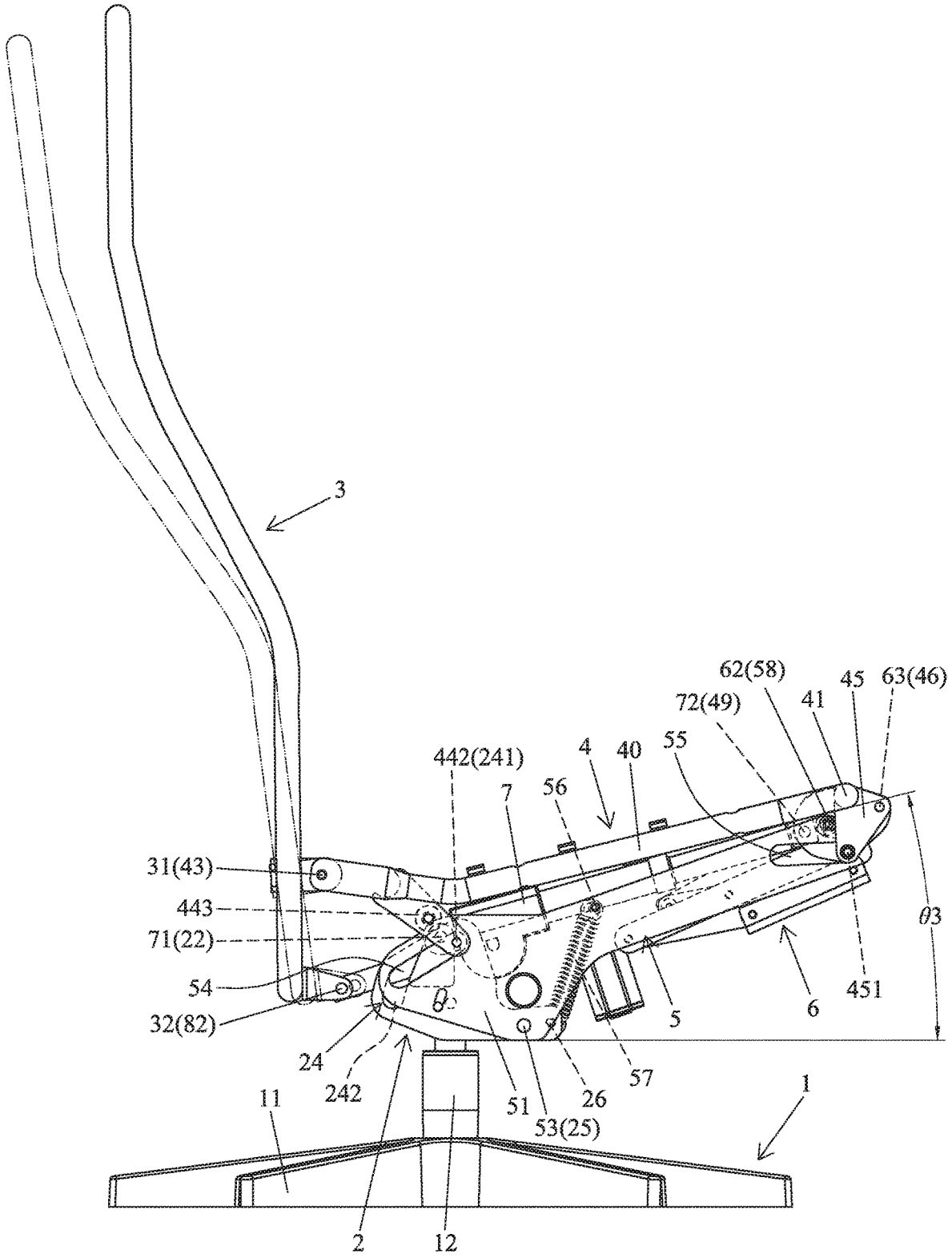
FIG. 4 is a side view of the chair assembly of FIG. 3.

With reference to FIGS. 1-7, a chair assembly of an embodiment according to the present invention includes a seat 1, a supporting frame 2, a backrest 3, a seat 4, an operating frame 5, a footrest 6, a first operating rod 7, and a second operating rod 8. The base 1 includes a base frame 11 having a supporting column 12.

The supporting frame 2 is disposed on top of the supporting column 12 of the base 1 and includes a transverse beam 21 extending parallel to the ground and coupled with the supporting column 12. The transverse beam 21 includes an upper end having first pivotal portion 22. Two supporting boards 23 are mounted to two ends of the transverse beam 21, extend perpendicularly to the ground, and are symmetric to each other. Each of the two supporting boards 23 includes a rear side having a first guiding groove 24. The first guiding groove 24 includes a front end having an inclined groove section 241 extending rearwards and downwards. The first guiding groove 24 further includes a lower groove section 242 extending downwards from a rear end of the inclined groove section 241. A top edge 24 of each first guiding groove 24 is parallel to a top edge of an associated one of the two supporting boards 23. Each of the two supporting boards 23 includes a front, lower portion having a second pivotal portion 25. Each of the two supporting boards 23 further includes an inner side having a lower peg 26.

The backrest 3 includes two sides each having a lower portion with a third pivotal portion 31. The backrest 3 further includes a lower end having a fourth pivotal portion 32.

The seat 4 includes a front rod 41, a rear rod 42, and two lateral rods 40 connected between the front rod 41 and the rear rod 42. Each of the two lateral rods 40 includes a rear end having a fifth pivotal portion 43 pivotably connected to an associated one of the third pivotal portions 31 of the backrest 3. The rear rod 42 further includes two rear guiding members 44 corresponding to the two supporting boards 23. Each of the two rear guiding members 44 includes two side boards 441 parallel to each other. Each of the two rear guiding members 44 includes a lower guiding wheel 442 disposed between lower portions of the two side boards 441 and an upper guiding wheel 443 disposed between upper portions of the two side boards 441. Each lower guiding wheel 442 is movably received in the first guiding groove 24 of an associated one of the two supporting boards 23. Each upper guiding wheel 443 is movable along the top edge of an associated one of the two supporting boards 23. The front rod 41 includes two front guiding boards 45 extending downwards. Two front guiding wheels 451 are respectively mounted to the two front guiding boards 45. The front rod 41 includes a front side having two sixth pivotal portions 46 and a rear side having a seventh pivotal portion 47 and a ninth pivotal portion 49. Each of the two lateral rods 40 of the seat 4 includes an intermediate portion having an eighth pivotal portion 48 extending towards a center of the seat 4.

The operating frame 5 is disposed below the seat 4 and includes two operating boards 51 located outside of the two supporting boards 23 and extending parallel to each other. A connecting rod 52 is interconnected between the two operating boards 51. Each of the two operating boards 51 includes a lower end having a tenth pivotal portion 53 pivotably connected to the second pivotal portion 25 of an associated one of the two supporting boards 23. Each of the two operating boards 51 includes a rear end having a second guiding groove 54 and a front end having a third guiding groove 55. Each second guiding groove 54 has a length substantially the same as a length of the inclined groove section 241 of an associated first guiding groove 24 and is located on a side of the inclined groove section 241 of the associated first guiding groove 24. Each third guiding groove 55 is substantially parallel to the ground. One of the two supporting board 23 and one of the two operating boards 51 are received between the two side boards 441 of an associated one of the two rear guiding members 44. Each lower guiding wheel 442 is movable in the associated first and second guiding grooves 24. Each upper guiding wheel 443 is movable on the top edge of an associated one of the two supporting boards 23. Each third guiding groove 55 is coupled with an associated front guiding wheel 451 of the seat 4, such that each front guiding wheel 451 is movably received in an associated third guiding groove 55. Each of the two operating boards 51 further includes an inner side having an upper peg 56. Two springs 57 are provided. Each of the two springs 57 is attached between an associated upper peg 56 and an associated lower peg 26. The spring forces of the two springs 57 prevent the operating frame 5 from wobbling to thereby improve the stability of the operating frame 5. Each of the two operating boards 51 includes a front, upper portion having an eleventh pivotal portion 58.

The footrest 6 includes a linking mechanism 61 that can collapse and extend in response to the movement of the seat 4. The linking mechanism 61 includes two twelfth pivotal portions 62 pivotably connected to the eleventh pivotal portions 58 of the two operating boards 51. The linking mechanism 61 further includes two thirteenth pivotal portions 63 pivotably connected to the two sixth pivotal portions 46 of the seat 4. The linking mechanism 61 further includes a fourteenth pivotal portion 64 pivotably connected to the seventh pivotal portion 47 of the seat 4.

The first operating rod 7 can be an electric rod or any telescopic rod. Two ends of the first operating rod 7 include a fifteenth pivotal portion 71 and a sixteenth pivotal portion 72, respectively. The fifteenth pivotal portion 71 is pivotably connected to the first pivotal portion 22 of the supporting frame 2. The sixteenth pivotal portion 72 is pivotably connected to the ninth pivotal portion 49 of the seat 4.

The second operating rod 8 can be an electric rod or any telescopic rod. Two ends of the second operating rod 8 includes a seventeenth pivotal portion 81 and an eighteenth pivotal portion 82, respectively. The seventeenth pivotal portion 81 is pivotably connected to the eighth pivotal portions 48 of the seat 4. The eighteenth pivotal portion 82 is pivotably connected to the fourth pivotal portion 32 of the backrest 3.

When the first operating rod 7 is in an extended position, each front guiding wheel 451 is located in a front end of an associated third guiding groove 55 of the operating frame 5, and each lower guiding wheel 451 is located in a front end of an associated first guiding groove 24 of the supporting frame 2 and a front end of an associated second guiding groove 54 of the operating frame 5. In this case, the upward inclining angle of the seat 4 is θ 3, and the footrest 6 is in the collapsed state for normal sitting purposes. Furthermore, the backrest 3 can be controlled by the second operating rod 8 to adjust the reclining angle. The angle of the backrest 3 is not affected by the seat 4, providing improved sitting comfort and more applications.

Figure 5:
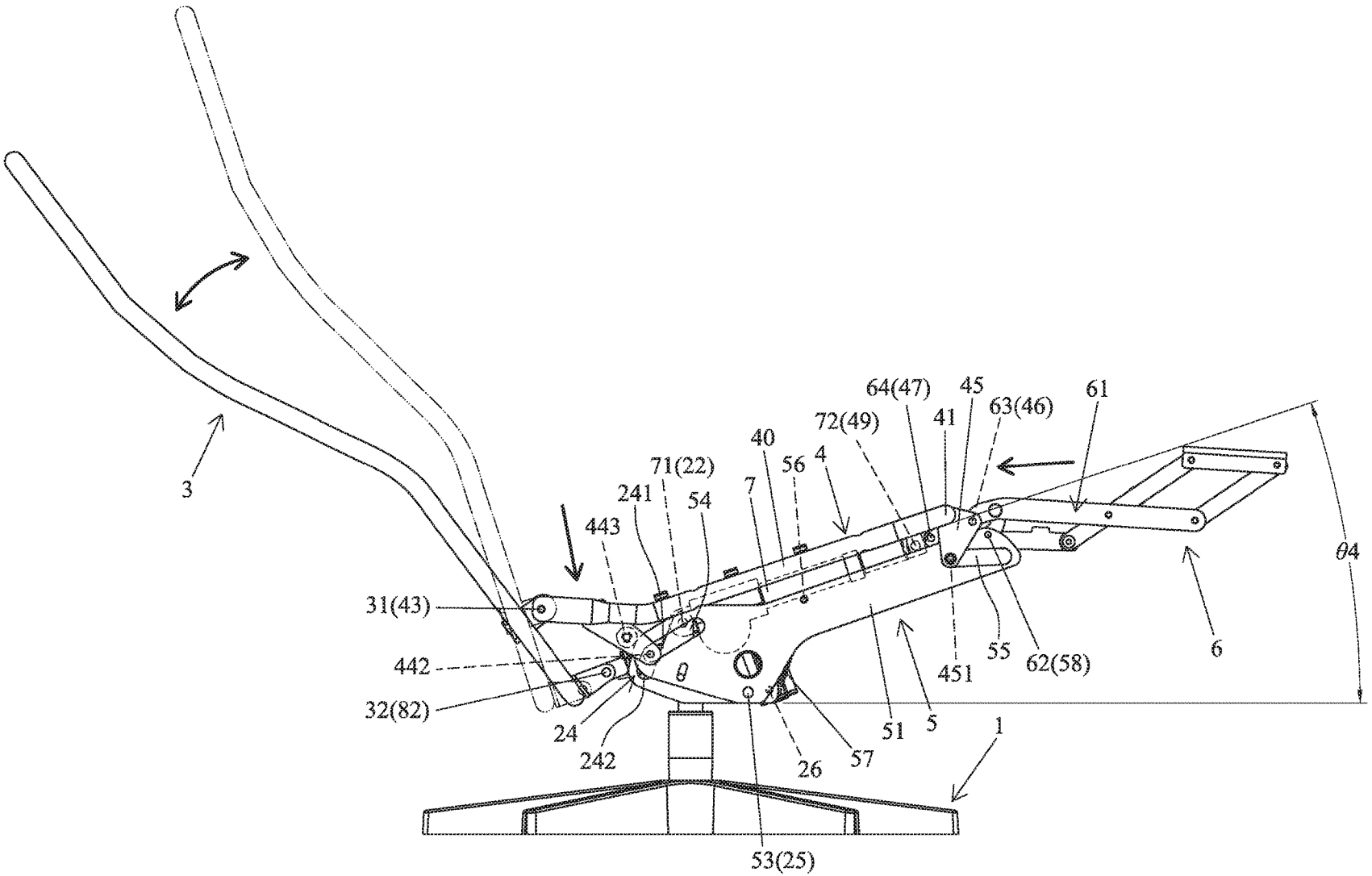
FIG. 5 is a side view similar to FIG. 4, with lower guiding wheels located in rear ends of inclined groove sections, with the seat moved rearwards, with a lower end of the seat moved downwards, and with a front end of the seat moved upwards.

With reference to FIGS. 1 and 5, when the first operating rod 7 moves to a retracted position, each front guiding wheel 451 moves to a rear end of the associated third guiding groove 55 and a rear end of the associated second guiding groove 54, each lower guiding wheel 451 moves to a rear end of the inclined groove section 241 of the associated first guiding groove 24, and each upper guiding wheel 443 moves to a rear end of the top edge of an associated one of the two supporting boards 23. Furthermore, the seat 4 moves downwards to actuate the linking mechanism 6 to extend forwards. Since the rear end of the inclined groove section 241 of each first guiding groove 24 is lower than the front end of the inclined groove section 241, the upward inclining angle θ 4 of the seat 4 is larger than the upward inclining angle θ 3 of the seat 4 that has not moved rearwards yet. This allows the center of gravity of the user to shift rearwards, and the user lies backwards against the backrest 3 to reduce the force imparted to the buttocks of the user. Furthermore, the reclining angle of the backrest 3 can be adjusted by the second operating rod 8 to improve the sitting comfort and more applications. When the seat 4 moves rearwards, the front end of the seat 4 is stably supported by the coupling between the front guiding wheels 451 and the third guiding grooves 55, and the rear end of the seat 4 is stably supported by the coupling between the lower guiding wheels 442 and the first and second guiding grooves 24 and 54, providing improved movement stability. Furthermore, the lower and upper guiding wheels 442 and 443 can clamp the top edges of the associated first guiding groove 24 and the associated supporting board 23, providing improved supporting strength and improved movement stability.

Figure 6:
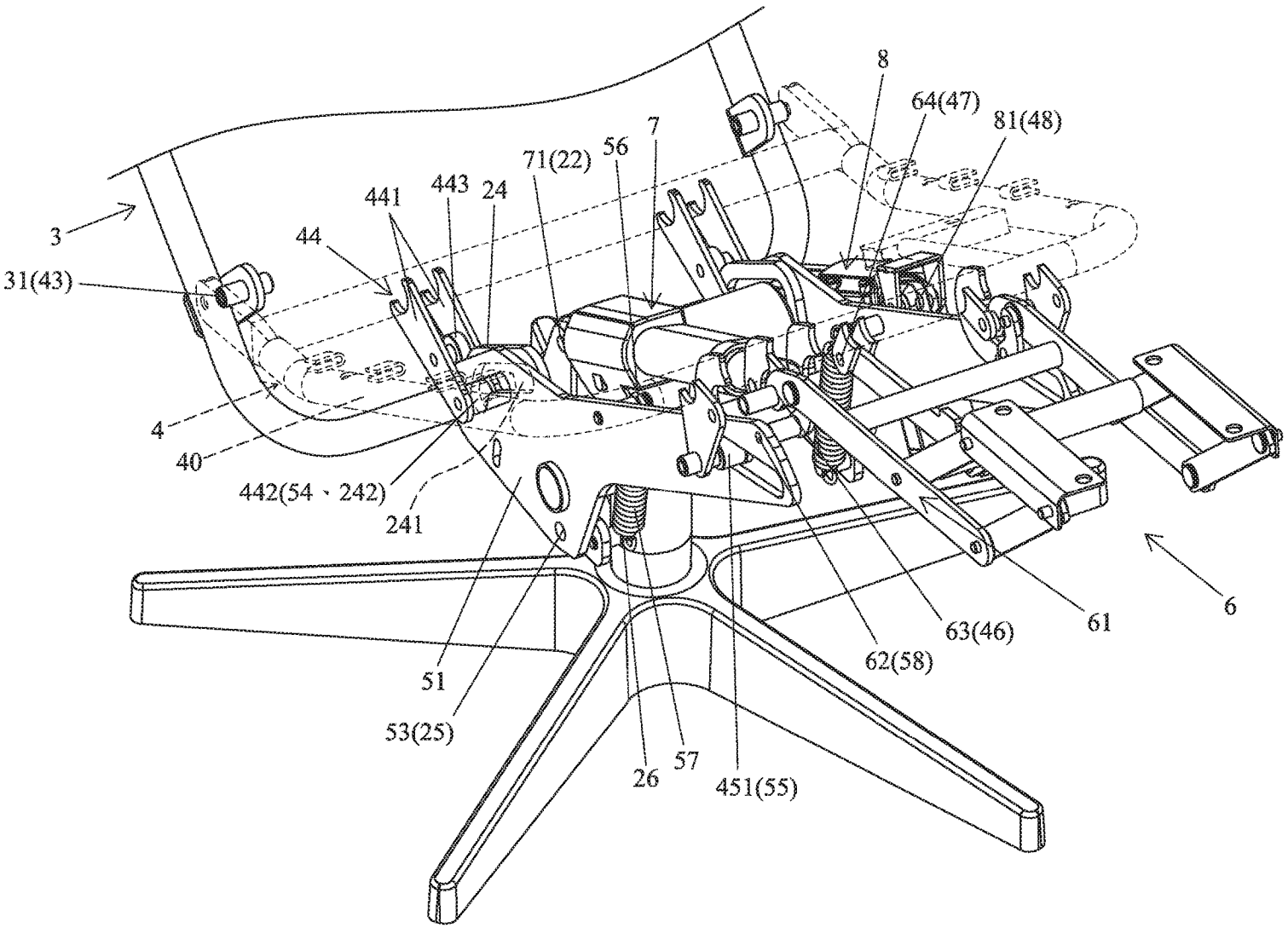
FIG. 6 is a view similar to FIG. 2, with the lower guiding wheels located in lower groove sections, with the seat moved rearwards, with the lower end of the seat moved downwards, and with the front end of the seat moved upwards.
Figure 7:
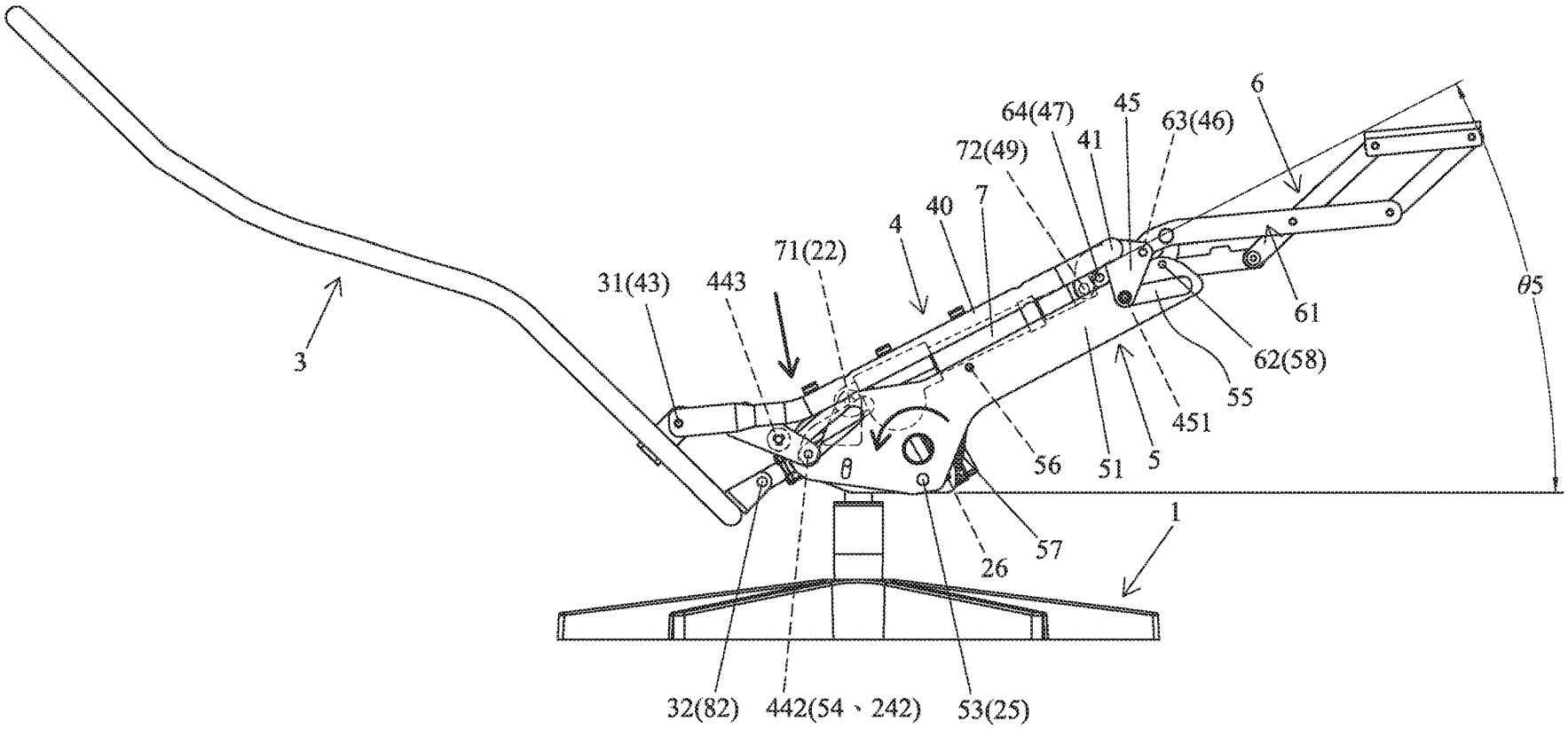
FIG. 7 is a side view similar to FIG. 5, with the seat moved rearwards, with the lower end of the seat moved downwards, and with the front end of the seat moved upwards.
Figure 8:
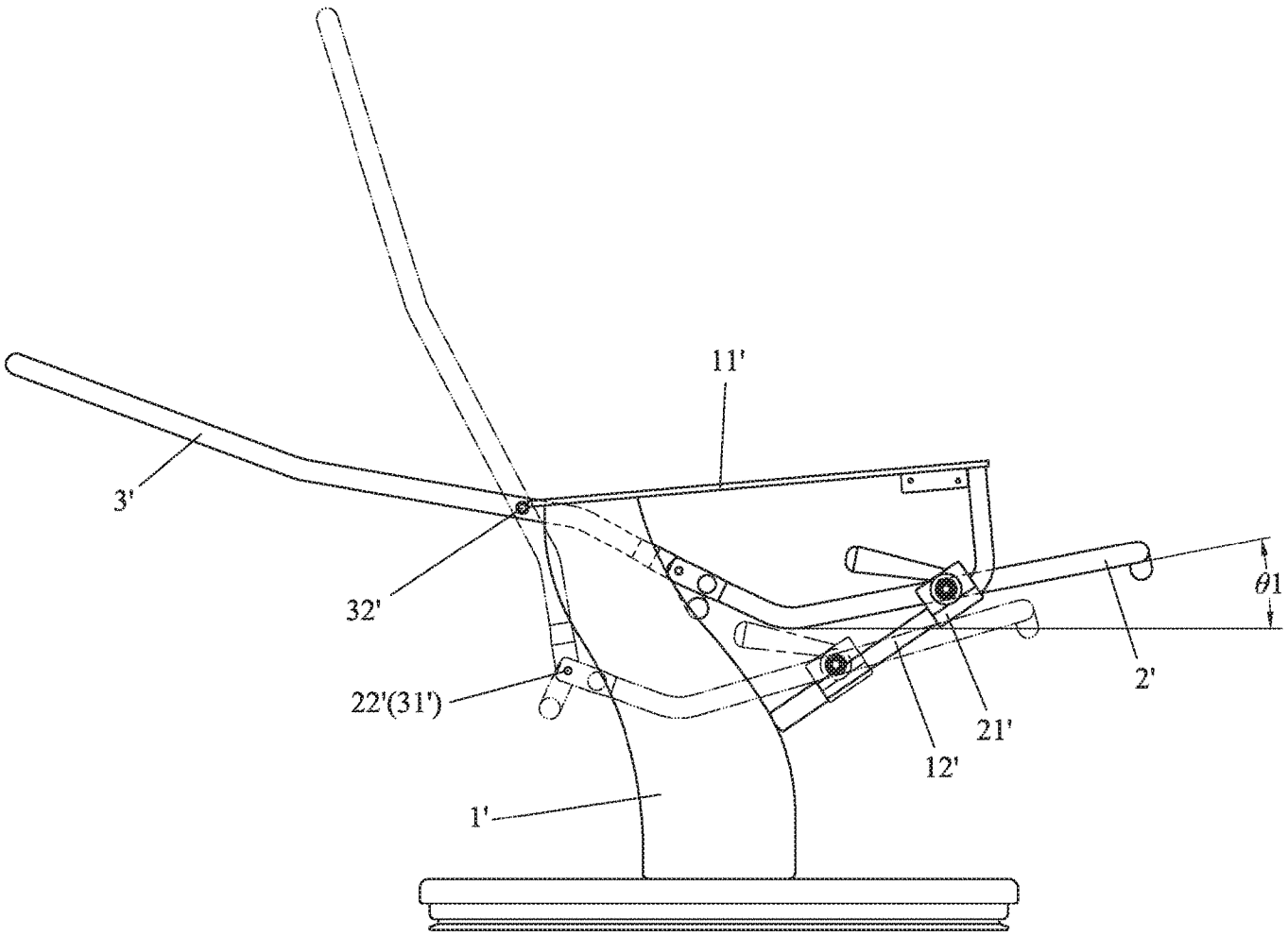
PRIOR ART FIG. 8
FIG. 8 is a diagrammatic side view of a conventional chair.
Figure 9:
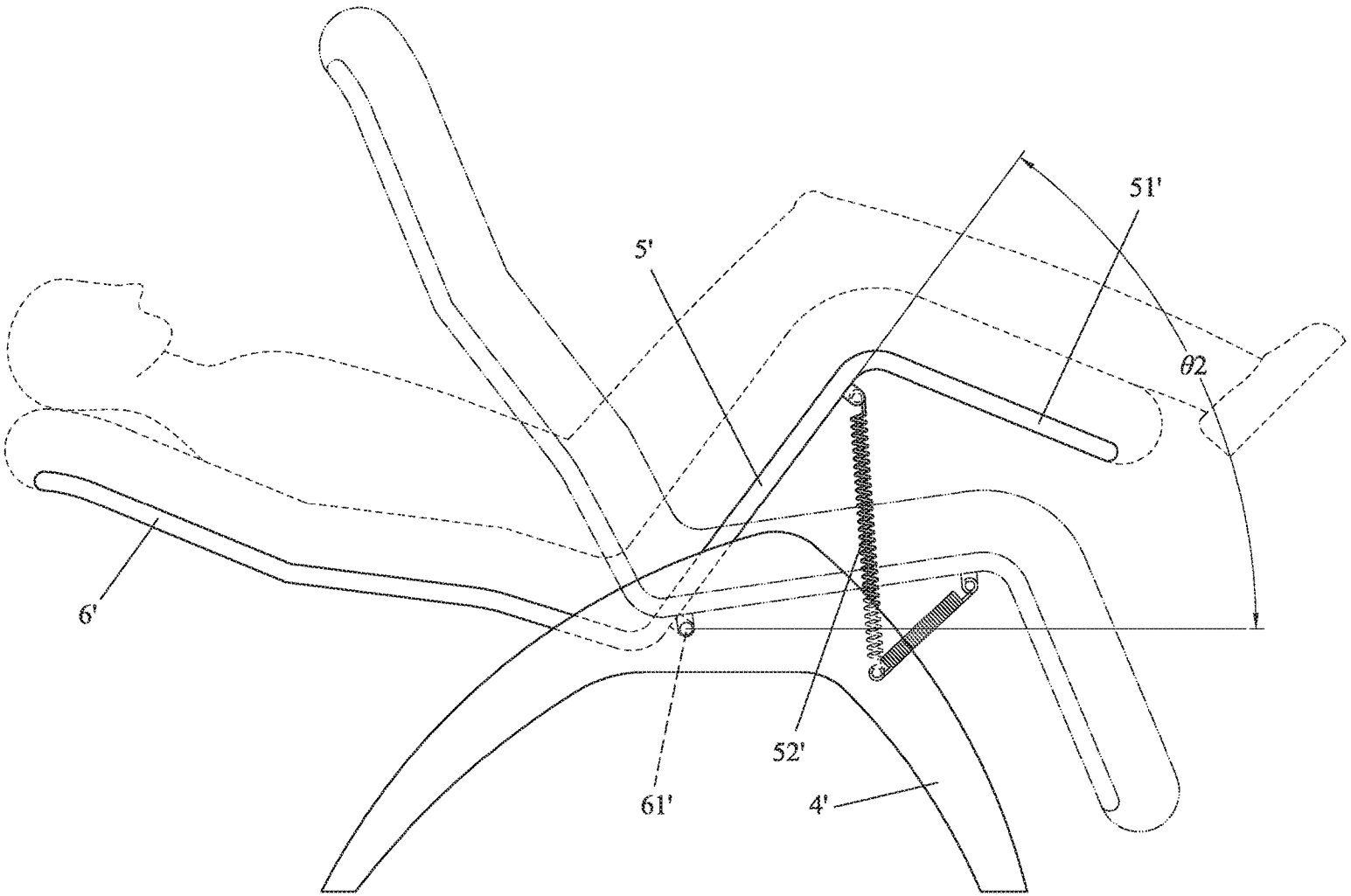
PRIOR ART FIG. 9
FIG. 9 is a diagrammatic side view of another conventional chair.

With reference to FIGS. 6 and 7, the first operating rod 7 can be operated to retract again, moving each lower guiding wheel 442 to the lower groove section 242 of the associated first guiding groove 24. Furthermore, the operating frame 5 is actuated to pivot about the second and tenth pivotal portions 25 and 53, such that the front end of the seat 4 can move further upward to an upward inclining angle θ 5 larger than the inclining angle θ 4 in which the lower guiding wheels 442 are located in the inclined groove sections 241. In this case, the backrest 3 can recline to a better lying angle through operation of the second operating rod 8, such that the pressure imparted to the buttocks can be more uniformly distributed rearwards to the back and the waist of the user, providing improved comfort. Furthermore, the user lies down, the user can lift the feet to improve the blood circulation, providing improved relaxing and comfort effect.

In view of the foregoing, the chair assembly according to the present invention provides improved lying comfort. Furthermore, in the normal sitting position, the angular position of the backrest 3 can be adjusted according to needs, thereby improving the sitting comfort. Furthermore, the chair assembly does not have to include the footrest 6.

Although specific embodiments have been illustrated and described, numerous modifications and variations are still possible without departing from the scope of the invention. The scope of the invention is limited by the accompanying claims.

The invention claimed is:

1. A chair assembly comprising:

a base;

a supporting frame disposed above the base and including at least one supporting board extending perpendicularly to a ground, wherein the at least one supporting board includes a rear side having a first guiding groove, and wherein the first guiding groove including an inclined groove section extending rearwards and downwards;

a backrest;

a seat including a rear end pivotably connected to the backrest, permitting adjustment of a reclining angle of the backrest, wherein the rear end of the seat includes at least one lower guiding wheel corresponding to the first guiding groove, and wherein the seat further includes a front end having at least one front guiding wheel;

an operating frame disposed below the seat and including at least one operating board disposed on a side of the at least one supporting board, wherein the at least one operating board includes a rear end having a second guiding groove and a front end having a third guiding groove, wherein the second guiding groove is aligned with and located on a side of the inclined groove section of the first guiding groove, wherein the at least one lower guiding wheel is movably received in the first guiding groove and the second guiding groove, wherein the third guiding groove has a slope different from a slope of the second guiding groove, and wherein the at least one front guiding wheel is movably received in the third guiding groove; and a first operating rod including two ends pivotably connected to the supporting frame and the seat, respectively, wherein when the first operating rod is in an extended position, the at least one lower guiding wheel is located in a front end of the first guiding groove and a front end of the second guiding groove, and the at least one front guiding wheel is located in a front end of the third guiding groove, and wherein when the first operating rod retracts, the at least one lower guiding wheel moves to a rear end of the first guiding groove and a rear end of the second guiding groove, the at least one front guiding wheel moves to a rear end of the third guiding groove, the seat moves rearwards, the rear end of the seat moves downwards while the seat is moving rearwards, and wherein the front end of the seat inclines upwards while the seat is moving rearwards.

2. The chair assembly as claimed in claim 1, wherein the first guiding groove further includes a lower groove section extending downwards from a rear end of the inclined groove section, wherein the operating frame is pivotably connected to the supporting frame, wherein when the first operating rod is operated to move the at least one lower guiding wheel of the seat to the lower groove section, the rear end of the seat moves downwards, the operating frame pivots, and the front end of the seat inclines upwards.

3. The chair assembly as claimed in claim 1, further comprising a second operating rod, wherein the lower end of the backrest is pivotably connected to the rear end of the seat, wherein two ends of the second operating rod are pivotably connected to the backrest and the seat, respectively, and wherein the second operating rod is operable to adjust a reclining angle of the backrest.

4. The chair assembly as claimed in claim 1, further comprising a footrest having a linking mechanism, wherein the linking mechanism is pivotably connected to the seat, wherein the linking mechanism collapses when the seat moves forwards, and wherein the linking mechanism extends when the seat moves rearwards.

5. The chair assembly as claimed in claim 1, further comprising at least one spring attached between the supporting frame and the operating frame.

6. The chair assembly as claimed in claim 1, wherein the seat includes a front rod, a rear rod, and two lateral rods connected between the front rod and the rear rod, wherein the rear rod includes at least one rear guiding member corresponding to the at least one supporting board, wherein the at least one rear guiding member includes two side boards parallel to each other, wherein the at least one supporting board and the at least one operating board are received between the two side boards, and wherein the at least one lower guiding wheel is disposed between lower portions of the two side boards.

7. The chair assembly as claimed in claim 6, wherein the first guiding groove has a top edge parallel to a top edge of the at least one supporting board, wherein an upper guiding wheel is disposed between upper portions of the two side boards and is located above the at least one lower guiding wheel, and wherein the upper guiding wheel is movable along the top edge of the at least one supporting board.

8. The chair assembly as claimed in claim 1, wherein the at least one supporting board includes two supporting boards each having the first guiding groove, wherein the at least one operating board includes two operating boards parallel to each other and located outside of the two supporting boards, wherein the supporting frame further includes a transverse beam interconnected between the two supporting boards, wherein each first guiding groove further includes a lower groove section extending downwards from a rear end of the inclined groove section of the first guiding groove, wherein each of the two supporting boards includes a front, lower portion having a second pivotal portion, wherein the seat includes a front rod, a rear rod, and two lateral rods connected between the front rod and the rear rod, wherein the rear rod includes two rear guiding members corresponding to the two supporting boards, wherein each of the two rear guiding members includes two side boards parallel to each other, wherein one of the two supporting board and one of the two operating boards are received between the two side boards of an associated one of the two rear guiding members, wherein each of the two rear guiding members includes a lower guiding wheel disposed between lower portions of the two side boards, wherein the front rod includes two front guiding boards extending downwards, wherein the at least one front guiding wheel includes two front guiding wheels respectively mounted to the two front guiding boards, wherein the front rod further includes a rear side having a ninth pivotal portion, wherein the operating frame further includes a connecting rod interconnected between the two operating boards, wherein each of the two operating boards includes a lower end having a tenth pivotal portion pivotably connected to the second pivotal portion of an associated one of the two supporting boards, wherein the two ends of the first operating rod include a fifteenth pivotal portion and a sixteenth pivotal portion, respectively, wherein the fifteenth pivotal portion is pivotably connected to the first pivotal portion of the supporting frame, and wherein the sixteenth pivotal portion is pivotably connected to the ninth pivotal portion of the seat.

9. The chair assembly as claimed in claim 8, further comprising a second operating rod, wherein the backrest includes two sides each having a lower portion with a third pivotal portion, wherein the backrest further includes a lower end having a fourth pivotal portion, wherein each of the two lateral rods of the seat includes a rear end having a fifth pivotal portion pivotably connected to an associated one of the third pivotal portions of the backrest, wherein each of the two lateral rods of the seat includes an intermediate portion having an eighth pivotal portion extending towards a center of the seat, wherein the two ends of the second operating rod includes a seventeenth pivotal portion and an eighteenth pivotal portion, respectively, wherein the seventeenth pivotal portion is pivotably connected to the eighth pivotal portions of the seat, wherein the eighteenth pivotal portion is pivotably connected to the fourth pivotal portion of the backrest, wherein each first guiding groove has a top edge parallel to a top edge of an associated one of the two supporting boards, wherein each of the two rear guiding members includes an upper guiding wheel disposed between upper portions of the two side boards and movable along the top edge of an associated one of the two supporting boards, and wherein the third guiding groove is substantially parallel to the ground.

10. The chair assembly as claimed in claim 8, further comprising a footrest, wherein the front rod of the seat includes two sixth pivotal portions and a seventh pivotal portion, wherein the linking mechanism of the footrest includes two twelfth pivotal portions pivotably connected to two eleventh pivotal portions of the two operating boards, wherein the linking mechanism further includes two thirteenth pivotal portions pivotably connected to the two sixth pivotal portions of the seat, and wherein the linking mechanism further includes a fourteenth pivotal portion pivotably connected to the seventh pivotal portion of the seat.

* * * * *